US006273418B1

(12) United States Patent
Fujikura et al.

(10) Patent No.: US 6,273,418 B1
(45) Date of Patent: Aug. 14, 2001

(54) SHEET REGISTRATION DEVICE AND AN IMAGE FORMING APPARATUS HAVING THE SAME

(75) Inventors: Hiroaki Fujikura; Takashi Abe; Shinji Hozumi, all of Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/199,283

(22) Filed: Nov. 25, 1998

(30) Foreign Application Priority Data

Dec. 26, 1997 (JP) ..... 9-358842

(51) Int. Cl.[7] ..... B65H 7/02

(52) U.S. Cl. ..... 271/228; 271/227; 271/248; 271/250; 271/251

(58) Field of Search ..... 271/227, 278, 271/248–252

(56) References Cited

U.S. PATENT DOCUMENTS

| | | | | |
|---|---|---|---|---|
| 3,929,327 | * | 12/1975 | Olson | 271/250 |
| 4,836,527 | * | 6/1989 | Wong | 271/251 |
| 4,855,607 | * | 8/1989 | Eckl | 250/557 |
| 5,219,159 | * | 6/1993 | Malachowski et al. | 271/228 |
| 5,273,274 | * | 12/1993 | Thomson et al. | 271/228 |
| 5,335,904 | * | 8/1994 | Ryuzaki | 271/272 |
| 5,507,482 | * | 4/1996 | Tenpaku et al. | 271/251 |
| 6,019,365 | * | 2/2000 | Matsumura | 271/227 |

FOREIGN PATENT DOCUMENTS

| | | |
|---|---|---|
| 62-46842 | 2/1987 | (JP) . |
| 63-127955 | 5/1988 | (JP) . |
| B2-2632405 | 4/1997 | (JP) . |

* cited by examiner

*Primary Examiner*—Donald P. Walsh
*Assistant Examiner*—David A. Jones
(74) *Attorney, Agent, or Firm*—Oliff & Berridge, PLC

(57) ABSTRACT

A sheet registration device includes: sheet transporting means for transporting a sheet in a transport direction thereof; a sheet positioning member which is disposed in a side of a sheet transport path and in parallel with the transport direction; lateral moving means for moving a sheet transported a long the sheet transport path, toward the sheet positioning member; detecting means for detecting a side edge of the sheet transported along the sheet transport path; moving means for moving the sheet transporting means in a direction perpendicular to the transport direction, the sheet transporting means being disposed downstream from the lateral moving means; and controlling means for, on the basis of a detection result of the detecting means, controlling a movement operation of the sheet transporting means by the moving means.

8 Claims, 8 Drawing Sheets

SHEET REGISTRATION DEVICE AND AN IMAGE FORMING APPARATUS HAVING THE SAME

BACKGROUND OF THE INVENTION

1. Field of the Invention

The present invention relates to a sheet registration device in an image forming apparatus such as a copier, and more particularly to a sheet registration device for correcting a skew of a sheet under transportation.

2. Description of the Related Art

In an image forming apparatus such as a copier, usually, a sheet serving as an object on which an image is to be formed is transported, and, during the transportation, the sheet is sometimes skewed because of various reasons (for example, a low assembly accuracy of mechanical parts, and a slip phenomenon). In such a case, when the sheet which remains to be skewed is sent into an image forming unit, an image is formed with being shifted with respect to the sheet. In a copier or the like having a duplex copying function, an image is formed on the first face of a sheet, the sheet is inverted by a sheet inverting unit, and then another image is formed on the second face. When the sheet is skewed, therefore, the images of the first and second faces are shifted from each other.

To comply with this, a sheet registration device for correcting a positional shift in a sheet under transportation which is caused by a skew or the like is incorporated in a sheet transporting system of an image forming apparatus. In such sheet registration devices, known are two registration systems, namely, a registration system according to a so-called lead registration reference in which the posture of a sheet under transportation is corrected with respect to the leading edge of the sheet, and a registration system according to a so-called side registration reference in which the posture of a sheet under transportation is corrected with respect to a side edge of the sheet.

In the registration system according to the lead registration reference, a long gate member which elongates in a direction perpendicular to the transport direction is reciprocably disposed at a midpoint of a sheet transport path, and the leading edge of a sheet under transportation is caused to abut against the gate member, thereby correcting a skew of the sheet.

By contrast, in the registration system according to the side registration reference, a reference wall is disposed at a side portion of a sheet transport path and in parallel with the transport direction, skewed rollers are disposed in the sheet transport path, a sheet under transportation is moved toward the reference wall by the skewed rollers, and a side edge of the sheet is caused to abut against the reference wall, thereby correcting a skew of the sheet.

However, the above-mentioned two registration systems have the following problems.

In the registration system according to the lead registration reference, the configuration in which the leading edge of a sheet is caused to abut against the gate member is employed. Therefore, a lead skew of the sheet can be corrected, but the side registration cannot be attained. Furthermore, a sheet must be temporally stopped with abutting against the gate member, and hence the system has a low productivity.

Strictly speaking, the deviation from parallelism between the lead and rear edges of a sheet is not zero. In a copier or the like having a duplex copying function, when the sheet is inverted by a sheet inverting unit, the leading edge of the sheet abuts against the gate member under the state where the leading and rear edged are replaced with each other. Due to the deviation from parallelism between the lead and rear edges of the sheet, therefore, images on the first and second faces are shifted from each other.

By contrast, in the registration system according to the side registration reference, the configuration is employed in which a sheet is caused by the transportation force exerted by the skewed rollers to abut against reference wall, thereby attaining the side registration. In the case of a sheet of a small thickness, when a side edge of the sheet is caused to abut against the reference wall by an excessive transportation force, therefore, the sheet buckles, and, at the instance when the sheet passes over the reference wall, the buckling is canceled so that the sheet returns to the original shape. The amount of the buckle depends on the quality and thickness of the sheet. After the sheet passes over the reference wall, therefore, the position of the side edge of the sheet is deviated from a desired position, and the amount of the deviation is varied in accordance with the quality of the sheet, etc.

SUMMARY OF THE INVENTION

The invention has been conducted in order to solve the problems discussed above. It is an object of the invention to provide a sheet registration device which can highly accurately correct a skew of a sheet under transportation without being affected by the quality and thickness of the sheet, etc.

The sheet registration device of the invention has a configuration including: sheet transporting means for transporting a sheet in a transport direction thereof; a sheet positioning member which is disposed in a side of a sheet transport path and in parallel with the transport direction; lateral moving means for moving a sheet transported along the sheet transport path, toward the sheet positioning member; detecting means for detecting a side edge of the sheet transported along the sheet transport path; moving means for moving the sheet transporting means in a direction perpendicular to the transport direction, the sheet transporting means being disposed downstream from the lateral moving means; and controlling means for, on the basis of a detection result of the detecting means, controlling a movement operation of the sheet transporting means by the moving means.

In the sheet registration device, a sheet which is sequentially transferred from the upstream side is moved toward the sheet positioning member by the lateral moving means, and hence a side edge of the sheet abuts against the sheet positioning member, whereby a skew of the sheet is corrected. After the skew of the sheet is corrected, the sheet transporting means is moved by the moving means in a direction perpendicular to the transport direction, so that the sheet is shifted in a direction along which the sheet is separated from the sheet positioning member. At this time, the side edge of the sheet is detected by the detecting means, and the controlling means controls the movement operation of the sheet transporting means on the basis of the detection result, thereby enabling the side edge of the sheet to be aligned with a desired reference position.

The other sheet registration device of the invention has a configuration including: sheet transporting means for transporting a sheet in a transport direction thereof; a sheet positioning member which is disposed in a side of a sheet transport path and in parallel with the transport direction; lateral moving means for moving a sheet transported along the sheet transport path, toward the sheet positioning member;

moving means for moving sheet transporting means in a direction perpendicular to the transport direction, the sheet transporting means being disposed downstream from the lateral moving means; acquiring means for acquiring information of the sheet transported along the sheet transport path; storage means for previously storing information of sheets and control amounts of movement with relating to one another; and controlling means for reading out a control amount of movement corresponding to the information of the sheet which is acquired by the acquiring means, from the storage means, and for, in accordance with the read out control amount of movement, controlling a movement operation of the sheet transporting means by the moving means.

In the sheet registration device, a sheet which is sequentially transferred from the upstream side is moved toward the sheet positioning member by the lateral moving means, and hence a side edge of the sheet abuts against the sheet positioning member, whereby a skew of the sheet is corrected. After the skew of the sheet is corrected, the sheet transporting means is moved by the moving means in a direction perpendicular to the transport direction, so that the sheet is shifted in a direction along which the sheet is separated from the sheet positioning member. At this time, the acquiring means previously acquires information of the sheet which is actually transported, and the controlling means reads out a control amount of movement corresponding to the acquired information of the sheet and controls the movement operation of the sheet transporting means by the moving means, thereby enabling the side edge of the sheet to be aligned with a desired reference position.

BRIEF DESCRIPTION OF THE DRAWINGS

Similar reference characters denote corresponding features consistently throughout the attached figures. The preferred embodiments of this invention will be described in detail, with reference to the following figures, wherein.

DETAILED DESCRIPTION OF THE PREFERRED EMBODIMENTS

Hereinafter, embodiments of the invention will be described in detail with reference to the accompanying drawings.

Figure 1:
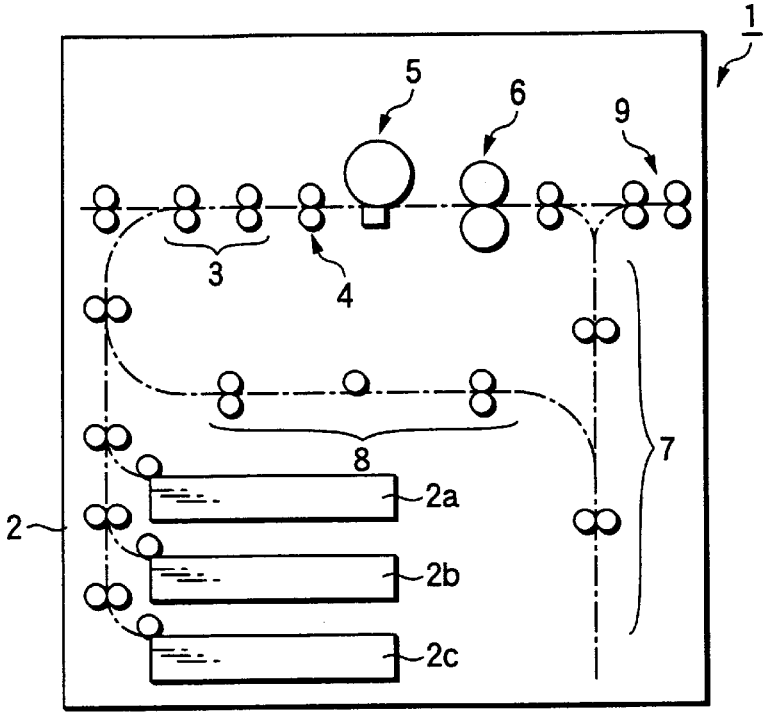
FIG. 1 is a schematic view showing an example of the configuration of an image forming apparatus to which the invention is applied.

FIG. 1 is a schematic view showing an example of the configuration of an image forming apparatus to which the invention is applied.

The illustrated image forming apparatus 1 comprises: a sheet supplying unit 2 for sending out a sheet serving as an object on which an image is to be formed; a sheet registration unit 3 which corrects the posture of the sheet under transportation; a registering unit 4 which sends out at a predetermined timing the sheet the posture of which is corrected by the sheet registration unit 3; an image transferring unit 5 which transfers an image to the sheet sent out by the registering unit 4; a fixing unit 6 which fixes the image which is transferred to the sheet by the image transferring unit 5; an inverting unit 7 which inverts the sheet under transportation; a resupplying unit 8 which sends out the sheet which is inverted in the inverting unit 7, to the sheet registration unit 3; and a discharging unit 9 which discharges the sheet on which images have been formed.

In the thus configured image forming apparatus, sheets of various sizes are accommodated in plural trays 2*a*, 2*b*, and 2*c* disposed in the sheet supplying unit 2. Sheets of the size which is selected manually or automatically from the sizes are sent out. The posture (a skew and the like) of a sheet which is sent out in this way is corrected in the sheet registration unit 3, and the sheet is then sent to the registering unit 4. The registering unit 4 sends out the sheet at a timing corresponding to, for example, the image formation timing in the image transferring unit 5. As a result, an image is transferred to the first face of the sheet sent to the image transferring unit 5.

In succession, the sheets to which the image has been transferred is sent to the fixing unit 6, and the image is fixed in the unit by means of heating and pressurization. In the case of simplex printing (in a copier, simplex copying), thereafter, the sheet is sent from the fixing unit 6 to the discharging unit 9 and then discharged to the outside of the apparatus without being subjected to a further process.

By contrast, in the case of duplex printing (in a copier, duplex copying), the sheet which has passed through the fixing unit 6 is sent to the inverting unit 7, and then inverted in the unit by a switchback system. The inverted sheet is horizontally transported by the resupplying unit 8 so as to be again sent into the sheet registration unit 3. Thereafter, another image is transferred to the second face of the sheet in the same manner as described above, and the sheet is then discharged to the outside of the apparatus by the discharging unit 9.

Figure 2:
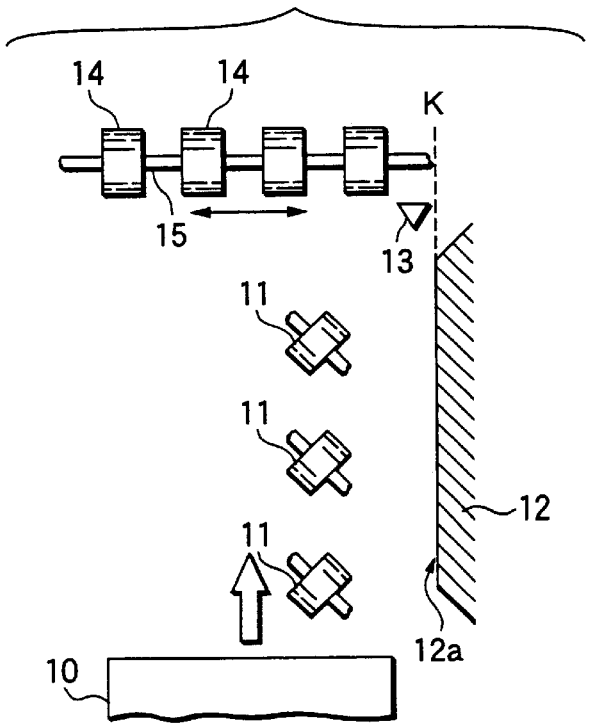
FIG. 2 is a schematic plan view of a sheet registration unit which is used in the embodiment of the invention.

FIG. 2 is a schematic plan view of the sheet registration unit 3 which is used in the embodiment of the invention.

Referring to FIG. 2, in the transport direction (the direction of the arrow of the figure) of a sheet 10, three skewed rollers 11 are sequentially disposed from the upstream side to the downstream side. The skewed rollers 11 are inclined by a predetermined angle with respect to the transport direction of the sheet 10. The skewed rollers 11 cooperate with lower rollers which are not shown, to constitute pairs of rollers, respectively.

A reference guide 12 serving as a sheet positioning member is disposed in a side of a sheet transport path along which the sheet 10 is transported, and in parallel with the transport direction of the sheet 10. The three skewed rollers 11 constitute lateral moving means for moving the sheet 10 which is sequentially transported from the upstream side, toward the reference guide 12. A side edge of the sheet 10 which is laterally moved by the lateral moving means 11 is caused to abut against an abutting face 12*a* of the reference guide 12.

A sheet side edge detecting sensor 13 is disposed downstream from the reference guide 12 so as to be located at a position in the sheet transport path which is inner by several millimeters than an abutting position K (indicated by the broken line in the figure) for the sheet 10 and formed by the abutting face 12*a*. The sheet side edge detecting sensor 13 serves as detecting means for detecting the side edge of the sheet 10 transported along the sheet transport path, and configured by, for example, an optical sensor which is a combination of a light emitting device and a light receiving device.

Plural (in the figure, four) transport rollers 14 are disposed downstream from the skewed rollers 11 and in a direction perpendicular to the transport direction. The transport rollers 14 are attached to a common rotation shaft 15 at given pitches. The transport rollers 14 serve as sheet transporting means in the sheet registration unit 3, and is rotated by the driving of a transport roller driving motor which will be described later, so as to apply a transportation force to the sheet 10.

Figure 3:
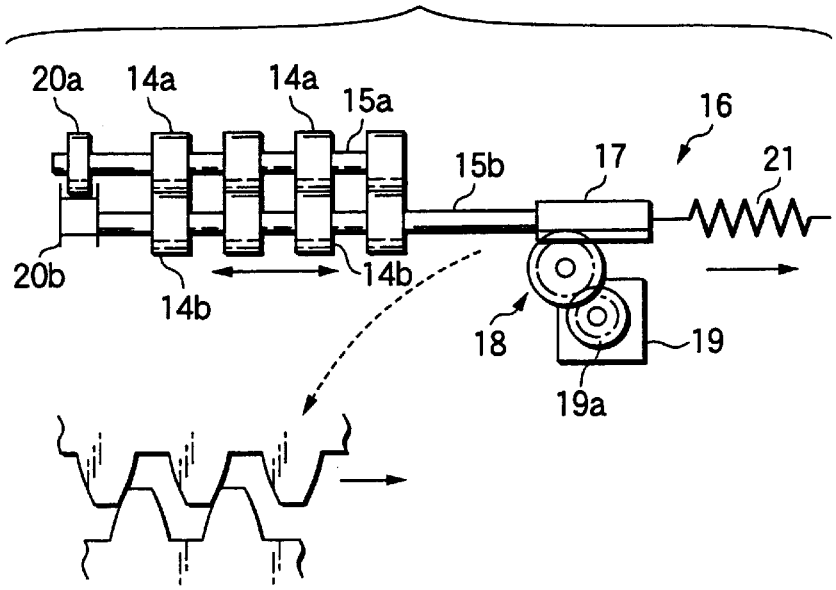
FIG. 3 is a front view schematically showing the configuration of a movement driving mechanism.

As shown in FIG. 3, each of the transport rollers 14 consists of a pair of an upper transport roller 14*a* and a lower transport roller 14*b*. The upper transport rollers 14*a* are attached to a rotation shaft 15*a*, and the lower transport rollers 14*b* to a rotation shaft 15*b*. The upper and lower rotation shafts 15*a* and 15*b* are respectively supported by bearing members which are not shown, so as to be movable in the axial direction (the lateral direction in the figure).

A movement driving mechanism 16 is coupled to one end of the rotation shaft 15*b*. The movement driving mechanism 16 corresponds to moving means for moving the transport rollers 14 (14*a*, 14*b*) in a direction perpendicular to the transport direction. The mechanism mainly comprises a rack member 17 mounted on one end of the rotation shaft 15*b*, a pinion gear 18 meshing with the rack member 17, and a side-shift motor 19 having a motor gear 19a which meshes with the pinion gear 18.

A first engaging member 20*a* is mounted on an end portion of the rotation shaft 15*a*. The first engaging member 20*a* is engagingly held by a second engaging member 20*b* mounted on the rotation shaft 15*b*. A coil spring 21 is engaged with an end portion of the lower rotation shaft 15*b* via the rack member 17. The transport rollers 14 (14*a*, 14*b*) are always urged by the pulling force of the coil spring 21 in the axial direction, i.e., the direction perpendicular to the transport direction of the sheet 10.

Figure 4:
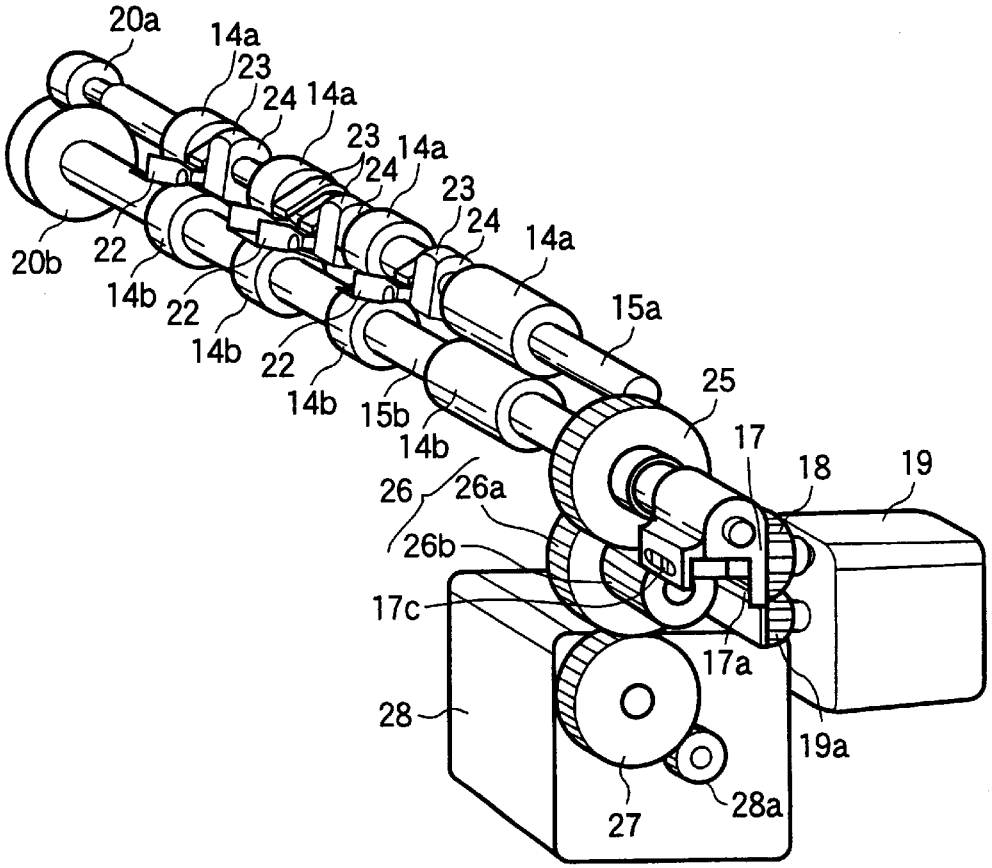
FIG. 4 is a perspective view specifically showing the configuration of a support structure for transport rollers.

FIG. 4 is a perspective view specifically showing the configuration of the support structure for the transport rollers 14 (14*a*, 14*b*) including the movement driving mechanism 16.

Referring to FIG. 4, bearing members 24 are mounted on spring peg members 22 fixed to a support frame (not shown), in such a manner that springs 23 are wound on the spring peg members, respectively. The upper rotation shaft 15*a* is rotatably supported by the bearing members 24 so as to be movable in the axial direction. A swinging arm which is not shown is coupled to each of the ends of the rotation shaft 15*a*. In accordance with the swinging operation of the swinging arms, the transport rollers 14*a* and 14*b* are nipped (pressingly contacted) or the nipped state is canceled.

On the other hand, also the lower rotation shaft 15*b* is rotatably supported by bearing members (not shown) so as to be movable in the axial direction. A gear train consisting of gears 25, 26, and 27 is disposed on the side of one end of the rotation shaft 15*b*. The gear 25 is attached together with the transport rollers 14*b* to the rotation shaft 15*b*, and the gears 26 and 27 are rotatably attached to a side frame which is not shown. The gear 26 has a structure in which a large-diameter gear portion 26*a* and a small-diameter gear portion 26b are integrated with each other. The gear 25 meshes with the small-diameter gear portion 26*b*, and the gear 27 with the large-diameter gear portion 26*a*. The gear 27 meshes also with a motor gear 28*a* attached to the output shaft of a transport roller driving motor 28.

The above-mentioned rack member 17 is attached an end portion of the rotation shaft 15*b* so as to be located at a position which is outer than the gear 25. Into the portion where the rack member 17 is coupled to the rotation shaft 15*b*, an engaging mechanism (for example, a mechanism for clamping the rack member 17 in the axial direction) for integrally moving the two components in the axial direction of the rotation shaft 15*b*, and a bearing mechanism which enables the rotation shaft 15*b* to be independently rotated with respect to the rack member 17 are incorporated.

Figure 5:
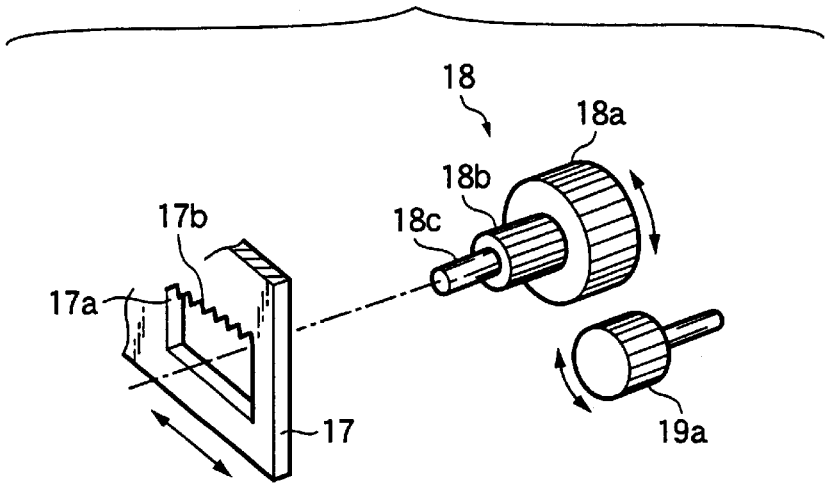
FIG. 5 is an exploded perspective view of a part of FIG. 4.

As shown in FIG. 5 also, a long hole 17*a* which elongates in the axial direction of the rotation shaft 15*b* is formed in the rack member 17. A gear portion 17*b* is formed on the upper edge of the long hole 17*a*. A guide hole 17*c* is formed in the rack member 17 at a position which is opposed to the long hole 17*a* with being separated therefrom by a predetermined distance.

By contrast, as shown in FIG. 5, the above-mentioned pinion gear 18 has a structure in which a large-diameter gear portion 18*a* and a small-diameter gear portion 18*b* are integrated with each other and a guide pin 18*c* coaxially protrudes from the small-diameter gear portion 18*b*. The large-diameter gear portion 18*a* meshes with the motor gear 19*a* of the side-shift motor 19, and the small-diameter gear portion 18*b* with the gear portion 17*b* of the rack member 17. The guide pin 18*c* of the pinion gear 18 is movably engaged with the guide hole 17*c* of the rack member 17.

In this mechanical configuration, when the side-shift motor 19 is driven, the driving force of the motor is transmitted from the motor gear 19*a* to the pinion gear 18 and the rack member 17. At this time, the rotational motion of the pinion gear 18 is transmitted to the gear portion 17*b* of the rack member 17, and hence the rotation shaft 15*b* is moved together with the rack member 17 in the axial direction, with the result that the transport rollers 14*b* attached to the shaft are moved in the direction perpendicular to the transport direction. Since the upper and lower rotation shafts 15*a* and 15*b* are engagingly held by the first and second engaging members 20*a* and 20*b*, also the rotation shaft 15*a* is moved in the axial direction with being interlocked with the rotation shaft 15*b*, whereby also the upper and lower transport rollers 14*a* and 14*b* are integrally moved in the direction perpendicular to the transport direction while maintaining their nipped state.

In direction perpendicular to the transport direction, the direction and amount of movement of the transport rollers 14 (14*a*, 14*b*) depend on the direction and amount of rotation of the side-shift motor 19. Specifically, when the side-shift motor 19 is driven so as to rotate in a cw (clockwise) direction in FIG. 3, the rotation shafts 15*a* and 15*b* and the transport rollers 14*a* and 14*b* are moved in the leftward direction in the figure in accordance with the amount of the driving, and, when the side-shift motor 19 is driven so as to rotate in a ccw (counterclockwise) direction in the figure, the rotation shafts 15*a* and 15*b* and the transport rollers 14*a* and 14*b* are moved in the rightward direction in the figure in accordance with the amount of the driving.

By contrast, when the transport roller driving motor 28 is driven, the driving force of the motor is transmitted from the motor gear 28*a* to the gears 27, 26, and 25. As a result, the rotation shaft 15*b* is rotated in accordance with the direction and amount of rotation of the transport roller driving motor 28, and the transport rollers 14*b* are rotated integrally with the rotation shaft 15*b*. Under the state where the upper and lower transport rollers 14*a* and 14*b* are nipped, the upper transport rollers 14*a* are followingly rotated by the lower transport rollers 14*b*. The rotational motions of the transport rollers 14*a* and 14*b* enables the sheet interposed between the rollers to be transported.

Figure 6:
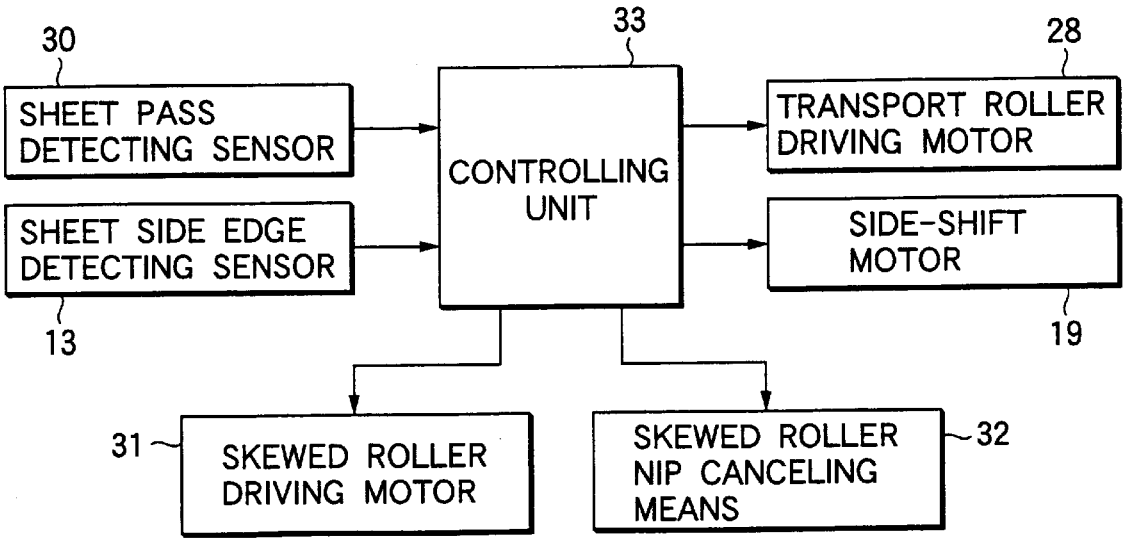
FIG. 6 is a functional block diagram showing the configuration of a control system relating to sheet registration.

FIG. 6 is a functional block diagram showing the configuration of a control system relating to sheet registration in a control system of the image forming apparatus.

Referring to FIG. 6, a sheet pass detecting sensor 30 is configured by, for example, an optical sensor which is a combination of a light emitting device and a light receiving device in the same manner as the sheet side edge detecting sensor 13, and disposed at a predetermined position of the sheet registration unit 3 so as to detect a pass of a sheet.

A skewed roller driving motor 31 serves as a driving source common to the above-mentioned skewed rollers 11. When the skewed roller driving motor 31 is driven, the skewed rollers 11 are rotated so as to be synchronous to one another.

Skewed roller nip canceling means 32 cancels the nip (pressingly contacted state) of the skewed rollers 11 which are respectively configured by pairs of upper and lower rollers.

A controlling unit 33 controls the transport roller driving motor 28, the side-shift motor 19, the skewed roller driving motor 31, and the skewed roller nip canceling means 32, on the basis of detection signals from the sheet pass detecting sensor 30 and the sheet side edge detecting sensor 13. The process procedure of the control will be described below in detail.

Figure 7:
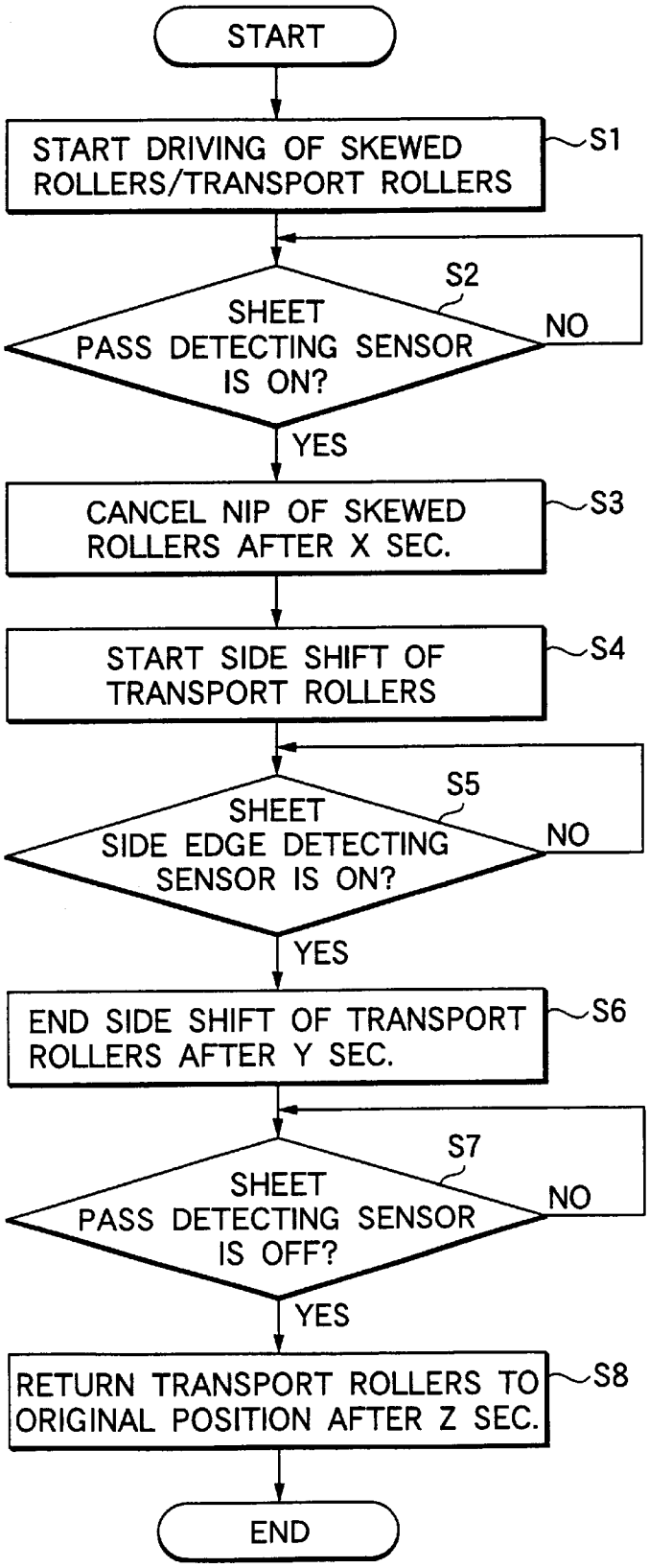
FIG. 7 is a flowchart showing a process procedure relating to sheet registration.

FIG. 7 is a flowchart showing the process procedure of the controlling unit 33 relating to sheet registration.

At the same time when the operation of forming an image is started, the transport roller driving motor 28 and the skewed roller driving motor 31 are driven so that the rotations of the skewed rollers 11 and the transport rollers 14 are started (step S1).

Figure 8A:
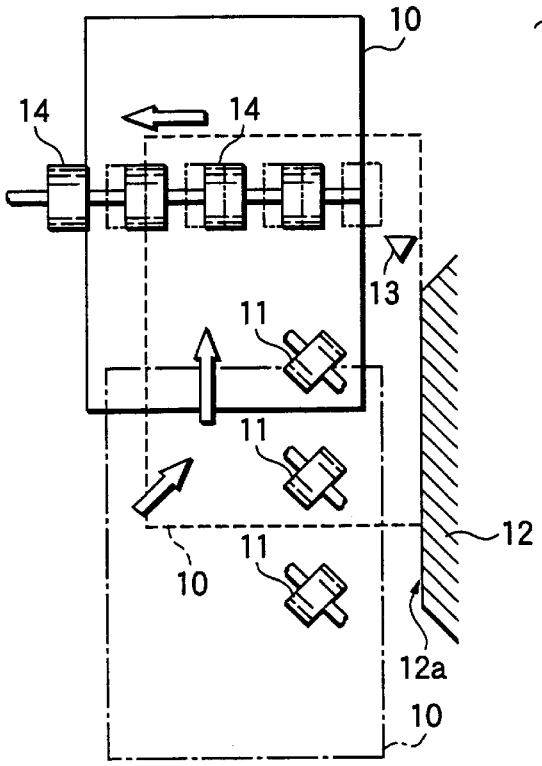
FIG. 8A is a top view showing an operation procedure relating to sheet registration.

At this time, a sheet serving as an object on which an image is to be formed is transported from the sheet supplying unit 2 to the sheet registration unit 3 along the sheet transport path. When the sheet reaches the sheet registration unit 3, the sheet is nipped by the skewed rollers 11. At this time, the skewed rollers 11 are rotated by the driving of the skewed roller driving motor 31, and hence the sheet 10 is moved as shown in FIG. 8A from the position indicated by the one-dot chain line in the figure to the position indicated by the broken line, i.e., toward the reference guide 12, in accordance with the rotation of the skewed rollers 11.

This causes a side edge of the sheet 10 to abut against the abutting face 12*a* of the reference guide 12. Therefore, a skew and the like which have appeared in the sheet 10 are corrected. At this time, if the sheet 10 is a yielding one, the side edge portion of the sheet is caused to buckle by the lateral moving function of the skewed rollers 11. While maintaining this state, the sheet is further transported to the downstream side in accordance with the rotation of the skewed rollers 11.

Thereafter, it is repeatedly judged whether the detection signal of the sheet pass detecting sensor 30 is turned on (ON) or not (step S2). The sheet pass detecting sensor 30 detects the pass of the sheet 10 at a position upstream or downstream from the transport rollers 14. When the pass is detected, the detection signal is turned on.

When the sheet pass detecting sensor 30 is turned on, the skewed roller nip canceling means 32 is driven after the elapse of a given time period (X sec.) to cancel the nipped state of the skewed rollers 11 (step S3). The given time period (X sec.) is adequately determined with respect to the timing when the sheet pass detecting sensor 30 is turned on, and in consideration of the time period which is required for the sheet 10 to be corrected in position by abutting against the reference guide 12 and then nipped by the transport rollers 14.

In the case where the sheet pass detecting sensor 30 is disposed downstream from the transport rollers 14, the nipped state of the skewed rollers 11 may be canceled at the same time when the detection signal is turned on.

In succession, the side-shift motor 19 is driven so that the side shift operation by the transport rollers 14 is started (step S4). At this time, when the rotation direction of the side-shift motor 19 is adequately controlled, the shift operation is started so that the transport rollers 14 are moved in the leftward direction in FIG. 8A. This causes the sheet 10 nipped by the transport rollers 14, to start the parallel movement (side shift) in a direction along which the sheet is separated from the reference guide 12 (the leftward direction in FIG. 8B), while being transported by the rotation of the transport rollers 14. In accordance with the movement of the transport rollers 14, the buckling portion of the sheet 10 is gradually canceled, and, at the timing when the side edge of the sheet is separated from the reference guide 12, the buckling of the sheet 10 is completely eliminated.

In succession, it is repeatedly judged whether the detection signal of the sheet side edge detecting sensor 13 is turned on (ON) or not (step S5). The sheet side edge detecting sensor 13 remains to be in the off state during a period when the sheet 10 exists at the detection position of the sensor, and is changed to the on state at the timing when the side edge of the sheet 10 is separated from the detection position.

In this case, the timing when the sheet side edge detecting sensor 13 is turned on corresponds to the amount of the buckle in the state where the side edge of the sheet 10 abuts against the reference guide 12.

Figure 8B:
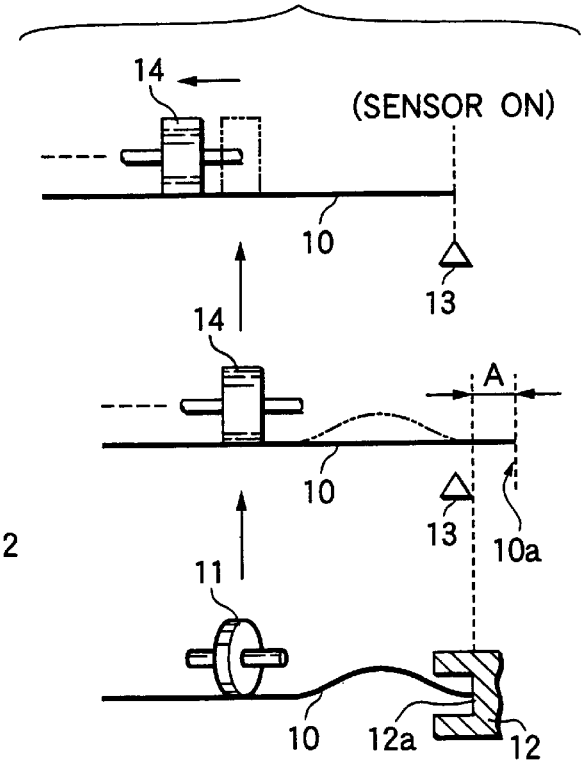
FIG. 8B is a side view showing the operation procedure shown in FIG. 8A.

This will be described in more detail. In the case where the sheet 10 which is caused by the skewed rollers 11 to abut against the reference guide 12 buckles, the sheet side edge position 10*a* in a virtual state where the buckling of the sheet 10 is eliminated is outward deviated by a dimension A from the abutting face 12*a* of the reference guide 12 as shown in FIG. 8B.

In the case of a yielding sheet, the sheet largely buckles as a result of the abutting against the reference guide 12. By contrast, in the case of a tough sheet, the sheet hardly buckles even when the sheet abuts against the reference guide 12. Therefore, the amount of deviation (the dimension A) of the sheet side edge position 10*a* in the virtual state is varied in accordance with the amount of the buckle of the sheet 10. On the other hand, the sheet side edge detecting sensor 13 is disposed at a position in the sheet transport pat which is inner than the abutting face 12*a* of the reference guide 12. Therefore, the timing when the sheet side edge detecting sensor 13 is turned on (the timing when the side edge of the sheet 10 separates from the sensor detection point) is later as the amount of the buckle (the dimension A) of the sheet 10 is larger.

When the sheet side edge detecting sensor 13 is turned on, the driving of the side-shift motor 19 is stopped after the elapse of a given time period (Y sec.) to end the side shift operation of the transport rollers 14 (step S6). Irrespective of the quality of the sheet 10 and the like, the given time period (Y sec.) is previously given to the controlling unit 33 as control data. The time period is adequately set in accordance with a desired sheet registration position in the direction perpendicular to the transportation direction. When the controlling unit is configured so that the given time period (Y sec.) is changeable, the registration position of the sheet 10 can be arbitrarily adjusted in the direction perpendicular to the transportation direction.

When the sheet pass detecting sensor 30 is then turned off (OFF), the side-shift motor 19 is rotated after the elapse of a given time period (Z sec.) from the off timing, in the direction opposite to that in the previous rotation and by the same amount of rotation as that in the previous rotation, whereby the transport rollers 14 are returned to the original position (initial position) (steps S7 and S8). The given time period (Z sec.) is adequately determined with respect to the timing when the sheet pass detecting sensor 30 is turned off, and in consideration of the time period which is required for the sheet 10 transported by the transport rollers 14 to be nipped by transport rollers (not shown) on the downstream side, and the rear end of the sheet 10 to pass over the transport rollers 14.

The skewed rollers 11 in which the nipped state has been canceled in step S3 may be returned to the original nipped state during a period from the timing when the rear end of the posture-corrected sheet 10 completely passes over the skewed rollers 11, and to that when the leading end of the subsequent sheet reaches the skewed rollers 11.

For example, another sheet pass detecting sensor may be disposed between the skewed rollers 11 and the transport rollers 14. The timing when the skewed rollers 11 are returned to the nipped state may be set to be a timing when this sheet pass detecting sensor detects the pass of the rear end of the sheet.

As described above, in the embodiment, the transport rollers 14 are supported so as to be movable in a direction perpendicular to the transportation direction of the sheet 10, by the movement driving mechanism 16 in which the side-shift motor 19 serves as the driving source, and the sheet side edge detecting sensor 13 for detecting a side edge of the sheet 10 is disposed. In an actual control operation, the posture (skew) of the sheet 10 is corrected by the abutting against the reference guide 12 by means of the skewed rollers 11, and thereafter the side shift operation of the transport rollers 14 is ended after the elapse of the given time period (Y sec.) after the sheet side edge detecting sensor 13 detects a side edge of the sheet 10. Even when the amount of the buckle (the dimension A) of the sheet 10 is varied in accordance with the quality of the sheet or the like, therefore, the position of the side edge of the sheet 10 can be always aligned with the desired reference position after the side shift operation.

In the image forming apparatus 1 having the sheet registration unit 3, therefore, an image can be transferred to a desired position on a sheet which is sent from the registering unit 4 to the image transferring unit 5 via the sheet registration unit 3. In the case of duplex copying, particularly, the image forming positions of the first and second faces can be correctly aligned with each other.

In the embodiment, the side shift operation is performed by the transport rollers 14 under the state where the nipped state of the skewed rollers 11 is canceled. Consequently, a twist of the sheet 10 caused by the nipping of the skewed rollers 11, regeneration of a skew, impairment of the registration position, and the like can be surely prevented from occurring. In the case where, during the shift operation of the transport rollers 14, the sheet 10 is nipped by the transport rollers (not shown) upstream from the skewed rollers 11, or by the transport rollers (not shown) downstream from the transport rollers 14, it is important to cancel also the nipped state of the transport rollers.

Figure 9A:
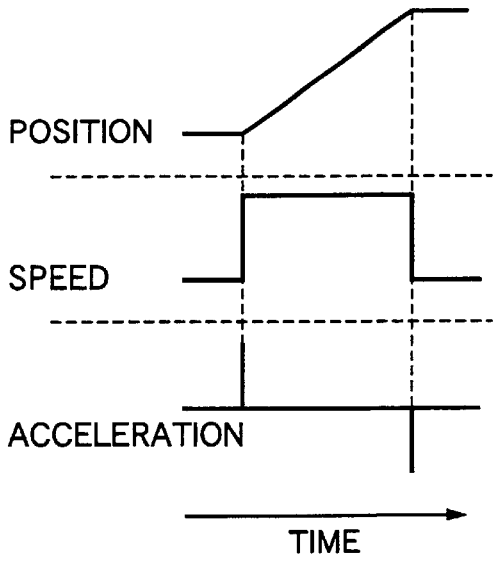
FIGS. 9A and 9B are comparison views of motor control systems relating to sheet registration.

When, as the method of controlling the driving of the side-shift motor 19, a method in which the acceleration of the motor is abruptly changed as shown in FIG. 9A, for example, the speed variation at the start and end of the driving of the motor is large. Consequently, there is a fear that the registration position of the sheet 10 is made misaligned by slippage between the transport rollers 14 and the sheet 10 or an inertia force of the moving body (the rotation shaft, and the like) including the transport rollers 14.

Figure 9B:
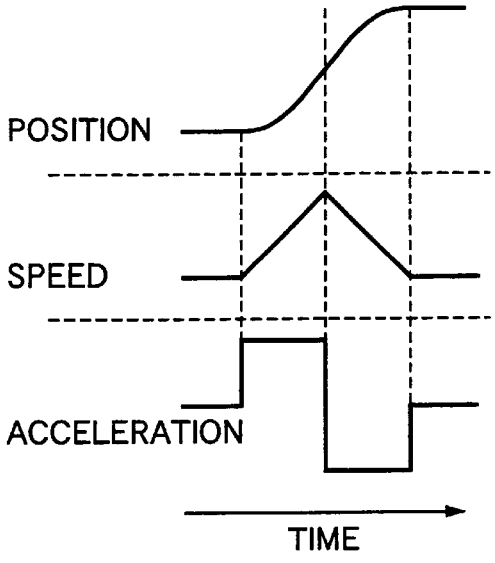

To comply with this, as shown in FIG. 9B, a control based on a trigonometric function (or an exponential function) may be employed in the control of the acceleration of the side-shift motor 19. In this case, the speed variation at the start and end of the driving of the motor is small, and hence it is possible to eliminate a disadvantage that the registration position of the sheet 10 is made misaligned.

In relation to the above, when the transport rollers 14 are urged in one direction (the direction perpendicular to the transportation direction) by the coil spring 21 as shown in FIG. 3 described above, the meshing portions between the rack member 17 and the pinion gear 18, and between the pinion gear 18 and the motor gear 19*a* are maintained in a state where the tooth surfaces of the same side are contacted with each other, irrespective of the relative rotation direction of the gears. According to this configuration, when the driving of the side-shift motor 19 is stopped so that the side shift operation of the transport rollers 14 is ended, the registration position of the sheet 10 is not made misaligned by backlash in the meshing portions of the gears. Therefore, the sheet registration accuracy is further enhanced.

Figure 10:
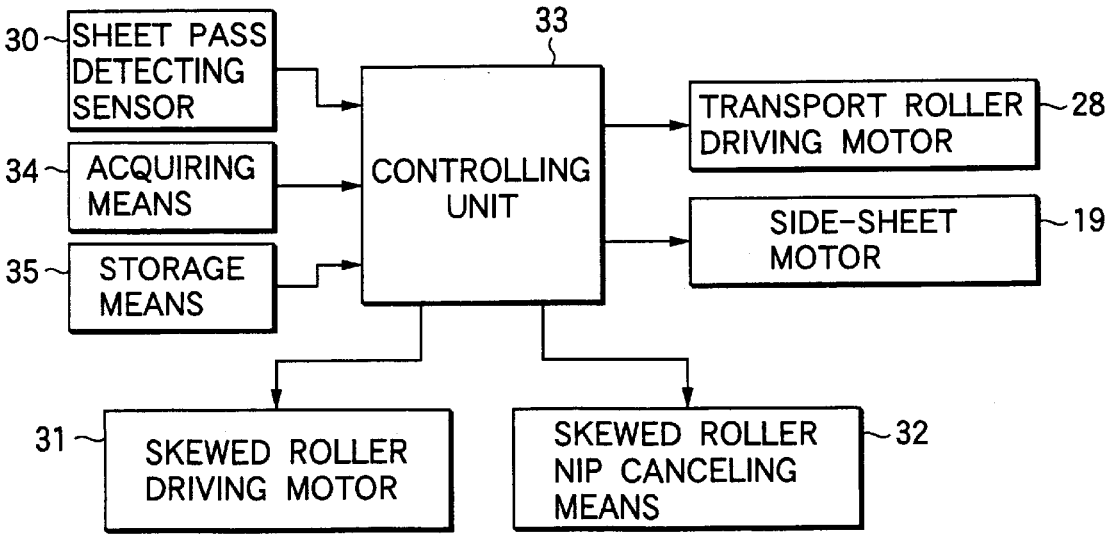
FIG. 10 is a functional block diagram showing the configuration of another control system relating to sheet registration.

FIG. 10 is a functional block diagram showing the configuration of a control system relating to sheet registration in another embodiment of the invention.

As compared with the control configuration (see FIG. 6) of the above-described embodiment, FIG. 10 is different in that, in place of the sheet side edge detecting sensor 13, acquiring means 34 and storage means 35 are disposed.

The acquiring means 34 acquires information of the sheet which is transported along the sheet transport path. Specifically, a sensor is disposed in the transportation path and downstream from the sheet registration unit 3, and information such as the quality and thickness of the sheet is acquired by the sensor. Alternatively, when the user previously inputs the kind of the sheet to be used (thick paper, thin paper, tracing paper, post card, or the like), the input information may be acquired as information of the sheet.

The storage means 35 has memories (such as a RAM) which stores various control data required for controlling, for example, the controlling unit 33, and previously stores the information of the sheet (thickness, quality, kind, and the like) and control amounts of movement with relating to one another. In the embodiment, since the transport rollers 14 are used as a transportation driving body for the sheet transporting means and the configuration in which the sheet 10 is side-shifted together with the transport rollers 14 is employed, the control amounts of movement correspond to the control data for controlling the amount of movement (the amount of side-shifting) of the transport rollers 14.

Specifically, in the case where the information of sheets relates to thicknesses, roller movement amounts La, Lb, . . . , Ln are stored in the form of a table so as to respectively correspond to thicknesses Pa, Pb, . . . , Pn as shown in Table 1 below. Experimental data which are obtained in the following manner are used as the roller movement amounts La, Lb, . . . , Ln. The amounts of movement of the transport rollers 14 which are required during the period from the state where sheets of each of the thicknesses Pa, Pb, . . . , Pn are caused to abut against the reference guide 12 by the skewed rollers 11, to that where the side end of each sheet is aligned with the desired reference position are previously experimentally obtained. The obtained amounts of movement are averaged for each thickness to obtain the experimental data.

TABLE 1

| information of sheet | amount of movement |
|---|---|
| Pa | La |
| Pb | Lb |
| . | . |
| . | . |
| . | . |
| Pn | Ln |

Figure 11:
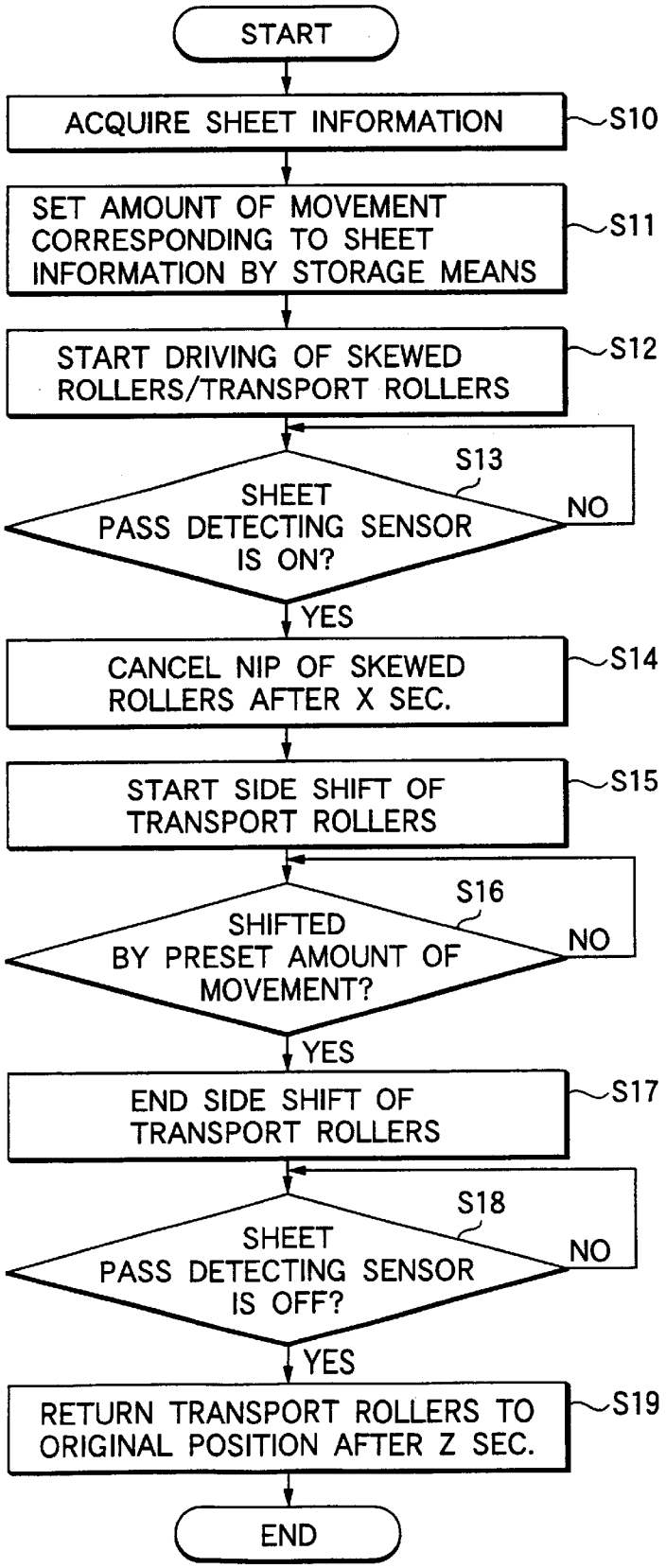
FIG. 11 is a flowchart showing another process procedure relating to sheet registration.

FIG. 11 is a flowchart showing the process procedure of the controlling unit 33 of the other embodiment of the invention.

First, when the operation of forming an image is started, sheet information which is input by the user, or that which is detected by the sensor is acquired (step S10).

Next, the roller movement amount which corresponds to the sheet information acquired in step S10 is read out from the storage means 35, and the read out amount of movement of the rollers is set as the motor control data (step S11). When the sheet information acquired by the acquiring means 34 is the thickness Pb, for example, the roller movement amount Lb corresponding to the thickness Pb is set as the motor control data.

Figure 12A:
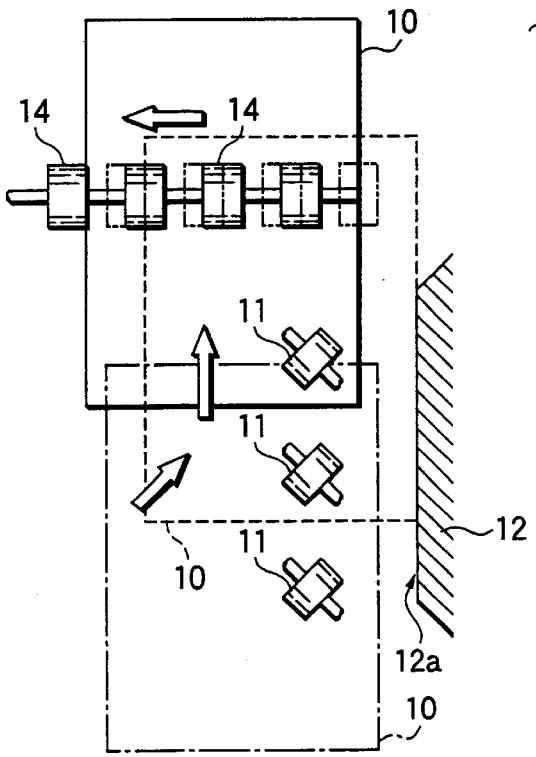
FIG. 12A is a top view showing another operation procedure relating to sheet registration.

The transport roller driving motor 28 and the skewed roller driving motor 31 are then driven so that the rotations of the skewed rollers 11 and the transport rollers 14 are started (step S12). At this time, a sheet serving as an object on which an image is to be formed is transported from the sheet supplying unit 2 to the sheet registration unit 3 along the sheet transport path. When the sheet reaches the sheet registration unit 3, the sheet is nipped by the skewed rollers 11. At this time, the skewed rollers 11 are rotated by the driving of the skewed roller driving motor 31, and hence the sheet 10 is moved as shown in FIG. 12A from the position indicated by the one-dot chain line in the figure to the position indicated by the broken line, i.e., toward the reference guide 12, in accordance with the rotation of the skewed rollers 11.

This causes a side edge of the sheet 10 to abut against the abutting face 12*a* of the reference guide 12. Therefore, a skew and the like which have appeared in the sheet 10 are corrected. At this time, if the sheet 10 is a yielding one, the side edge portion of the sheet is caused to buckle by the lateral moving function of the skewed rollers 11. Under this state, the sheet side edge position 10*a* in a virtual state where the buckling of the sheet 10 is eliminated is outward deviated by a dimension A from the abutting face 12*a* of the reference guide 12.

Thereafter, it is repeatedly judged whether the detection signal of the sheet pass detecting sensor 30 is turned on (ON) or not (step S13). The sheet pass detecting sensor 30 detects the pass of the sheet 10 at a position upstream or downstream from the transport rollers 14. When the pass is detected, the detection signal is turned on.

When the sheet pass detecting sensor 30 is turned on, the skewed roller nip canceling means 32 is driven after the elapse of a given time period (X sec.) to cancel the nipped state of the skewed rollers 11 (step S14).

Figure 12B:
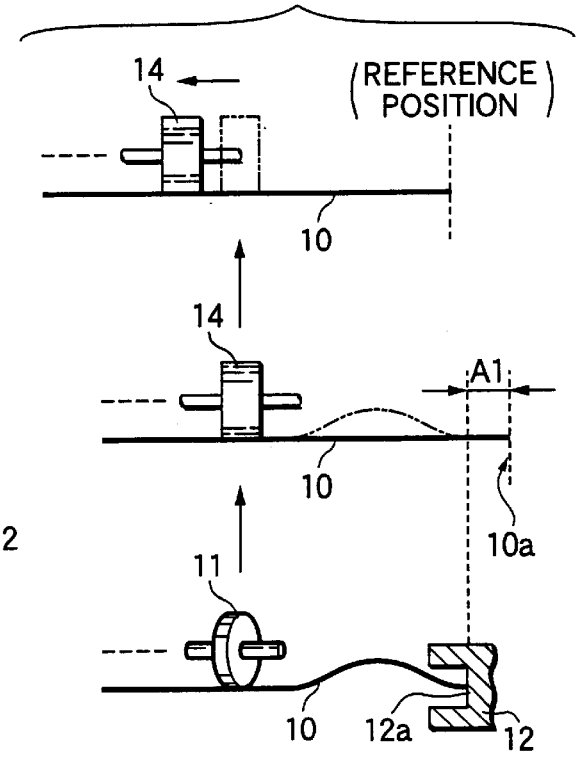
FIG. 12B is a side view showing the operation procedure shown in FIG. 12A.

In succession, the side-shift motor 19 is driven so that the side shift operation by the transport rollers 14 is started (step S15). At this time, when the rotation direction of the side-shift motor 19 is adequately controlled, the shift operation is started so that the transport rollers 14 are moved in the leftward direction in FIG. 12B. This causes the sheet 10 nipped by the transport rollers 14, to start the parallel movement (side shift) in a direction along which the sheet is separated from the reference guide 12 (the leftward direction in FIG. 12B), while being transported by the rotation of the transport rollers 14. In accordance with the movement of the transport rollers 14, the buckling portion of the sheet 10 is gradually canceled, and, at the timing when the side edge of the sheet is separated from the reference guide 12, the buckling of the sheet 10 is completely eliminated.

In succession, it is repeatedly judged whether the transport rollers 14 are shifted by the amount of movement which has been set in step S11 or not (step S16). The amount of movement of the transport rollers 14 corresponds to the amount of driving of the side-shift motor 19. When a pulse motor is used as the side-shift motor 19, for example, the roller movement amount is set in step S11 in the form of the number of motor driving pulses. In step S16, the number of driving pulses supplied to the side-shift motor 19 is compared with the pulse number which is set in step S11, to judge whether the transport rollers 14 are shifted by the preset amount of movement or not.

When the amount of movement of the transport rollers 14 reaches the preset amount of movement, the driving of the side-shift motor 19 is stopped so that the side shift operation of the transport rollers 14 is ended (step S17). When the sheet pass detecting sensor 30 is then turned off (OFF), the side-shift. motor 19 is rotated after the elapse of a given time period (Z sec.) from the off timing, in the direction opposite to that in the previous rotation and by the same amount of rotation as that in the previous rotation, whereby the transport rollers 14 are returned to the original position (initial position) (steps S18 and S19).

As described above, in the other embodiment, the transport rollers 14 are supported so as to be movable in a direction perpendicular to the transportation direction of the sheet 10, by the movement driving mechanism 16 in which the side-shift motor 19 serves as the driving source, and the acquiring means 34 for acquiring information of the sheet (thickness, quality, kind, and the like) and the storage means 35 for storing information of the roller movement amounts with relating to one another are disposed. In an actual control operation, after the posture (skew) of the sheet 10 is corrected by the abutting against the reference guide 12 by means of the skewed rollers 11, the roller movement amount corresponding to the information of the sheet acquired by the acquiring means 34 is read out from the storage means 35, and the amount of movement (the amount of side-shifting) of the transport rollers 14 is controlled in accordance with the read out roller movement amount. Even when the amount of the buckle (the dimension A) of the sheet 10 is varied in accordance with the quality of the sheet or the like, therefore, the position of the side edge of the sheet 10 can be always aligned with the desired reference position after the side shift operation. The other embodiment can attain the same effects as those of the embodiment described above.

As described above, according to the sheet registration device of the invention, in the configuration in which a sheet transported along the sheet transport path is moved toward the sheet positioning member by the lateral moving means to correct a skew, a side edge of the sheet is detected while, after the skew of the sheet is corrected, the sheet transporting means is moved by the moving means in a direction perpendicular to the transportation direction, and the movement operation of the sheet transporting means is controlled on the basis of the detection result. Therefore, the skew of the sheet can be surely corrected and a side edge of the sheet can be aligned with a desired reference position without being affected by the quality of the sheet or the like.

Furthermore, according to the other sheet registration device of the invention, in the configuration in which a sheet transported along the sheet transport path is moved toward the sheet positioning member by the lateral moving means to correct a skew, after the skew of the sheet is corrected, the sheet transporting means is moved by the moving means in a direction perpendicular to the transportation direction, and the movement operation is controlled in accordance with the control amount of movement corresponding to information of the sheet. Therefore, the skew of the sheet can be surely corrected and a side edge of the sheet can be aligned with a desired reference position without being affected by the quality of the sheet or the like.

The entire disclosure of each and every foreign patent application from which the benefit of foreign priority has been claimed in the present application is incorporated herein by reference, as if fully set forth.

While only certain embodiments of the invention have been specifically described herein, it will apparent that numerous modifications may be made thereto without departing from the spirit and scope of the invention.

What is claimed is:

1. A sheet registration device comprising:

sheet transporting means for transporting a sheet in a transport direction thereof;

a sheet positioning member which is disposed in a side of a sheet transport path and in parallel with the transport direction;

lateral moving means for moving a sheet transported along said sheet transport path, toward said sheet positioning member;

detecting means for detecting a side edge of the sheet transported along said sheet transport path;

moving means for moving said sheet transporting means in a direction perpendicular to the transport direction, said sheet transporting means being disposed downstream from said lateral moving means; and controlling means for, on the basis of a detection result of said detecting means, controlling a movement operation of said sheet transporting means by said moving means.

2. A sheet registration device according to claim 1, further comprising urging means for urging said sheet transporting means in the direction perpendicular to the transport direction and opposite the direction of the moving means.

3. A sheet registration device according to claim 1, wherein said control means further controls so as to stop the operation of said lateral moving means at a predetermined timing after the sheet is transported to said sheet transporting means.

4. A sheet registration device comprising:

a sheet transporting means that transports a sheet in a transport direction;

a sheet positioning member which is disposed on a side of a sheet transport path and in parallel with the transport direction;

a lateral moving means for moving the sheet transported along the sheet transport path toward the sheet positioning member;

a moving means for moving the sheet transporting means in a direction perpendicular to the transport direction, the sheet transporting means is located downstream from the lateral moving means;

an acquiring means for acquiring information about the sheet transported along the sheet transport path;

a storage means that stores information about the sheet and an amount of movement; and a controlling means that reads an amount of movement corresponding to the information about the sheet and controls a movement operation of the moving means.

5. A sheet registration device according to claim 4, further comprising urging means for urging said sheet transporting means in the direction perpendicular to the transport direction and opposite the direction of the moving means.

6. A sheet registration device according to claim 4, wherein said control means further controls operation of the moving means so as to stop the operation at a predetermined place after the sheet is transported to the sheet transporting means.

7. An image fonning apparatus having a sheet supply unit, a sheet registration unit, an image transfer unit, and a sheet discharge unit, the sheet registration unit comprising:

sheet transporting means for transporting a sheet in a transport direction thereof;

a sheet positioning member which is disposed in a side of a sheet transport path and in parallel with the transport direction;

lateral moving means for moving a sheet transported along said sheet transport path, toward said sheet positioning member;

detecting means for detecting a side edge of the sheet transported along said sheet transport path;

moving means for moving said sheet transporting means in a direction perpendicular to the transport direction, said sheet transporting means being disposed downstream from said lateral moving means; and controlling means for, on the basis of a detection result of said detecting means, controlling a movement operation of said sheet transporting means by said moving means.

8. An image forming apparatus having a sheet supply unit, a sheet registration unit, an image transfer unit, and a sheet discharge unit, the sheet registration unit comprising:

sheet transporting means that transports a sheet in a transport direction;

a sheet positioning member which is disposed on a side of a sheet transport path and in parallel with the transport direction;

a lateral moving means for moving the sheet transported along the sheet transport path toward the sheet positioning member;

a moving means for moving the sheet transporting means in a direction perpendicular to the transport direction, the sheet transporting means is located downstream from the lateral moving means;

an acquiring means for acquiring information about the sheet transported along the sheet transport path;

a storage means that stores information about the sheet and an amount of movement; and a controlling means that reads an amount of movement corresponding to the information about the sheet and controls a movement operation of the moving means.

* * * * *